United States Patent [19]

Griffith et al.

[11] 4,139,455

[45] Feb. 13, 1979

[54] MATERIALS AND PROCESSES FOR FLOTATION OF MINERAL SUBSTANCES

[75] Inventors: Robert M. Griffith, Bradford; Christopher Parkinson, Halifax; Ronald A. Palmer, Bradford, all of England

[73] Assignee: Allied Colloids Limited, Bradford, England

[21] Appl. No.: 628,614

[22] Filed: Nov. 4, 1975

[30] Foreign Application Priority Data

Nov. 19, 1974 [GB] United Kingdom ..... 49981/74

[51] Int. Cl.[2] ..... B03D 1/06

[52] U.S. Cl. ..... 209/167; 75/2

[58] Field of Search ..... 75/2; 423/26, 99, 101, 423/89, 92, 138, 140; 209/9, 166, 167, 5; 252/61; 260/695

[56] References Cited

U.S. PATENT DOCUMENTS

| | | | |
|---|---|---|---|
| 3,784,649 | 1/1974 | Buckman et al. | 75/1 R |
| 3,834,533 | 9/1974 | McGuire et al. | 209/166 |
| 4,054,516 | 10/1977 | Izumi et al. | 209/167 |

*Primary Examiner*—L. Dewayne Rutledge
*Assistant Examiner*—Michael L. Lewis
*Attorney, Agent, or Firm*—Lawrence Rosen; E. Janet Berry

[57] ABSTRACT

This invention provides a method of concentrating a metaliferous ore containing also substantial quantities of pyrites and/or pyrrhotite and/or sphalerite and comprises subjecting an aqueous pulp of the ore to a froth flotation process in the presence of a depressant and in which (1) pyrites and/or pyrrhotite, and/or (2) sphalerite, is depressed by using as the depressant an amine in which at least 20% of the total number of amine groups are tertiary amine groups and in which the number of quaternary amine groups present is zero or is less than one-third the number of tertiary amine groups.

8 Claims, No Drawings

MATERIALS AND PROCESSES FOR FLOTATION OF MINERAL SUBSTANCES

This invention relates to improvements in the beneficiation of metaliferous mineral ores and especially to the beneficiation of metaliferous sulphide minerals associated with pyrite and/or pyrrhotite and/or sphalerite minerals The use of froth flotation processes for the beneficiation of mineral ores is very well known. The object of the process usually is to produce concentrates of certain mineral substances from the crude ore in which the required mineral substances are diluted by the presence of other minerals which are unavoidably extracted with them in the mining operation. The essential features of the froth flotation process consist of first grinding the crude ore to such an extent that discrete particles of the required minerals occur and then subjecting an aqueous "pulp" of the crude ground ore to agitation in the presence of rising air bubbles.

To assist the process a chemical substance known as a "collector" is incorporated into the mass and by virtue of its chemical and physical properties this collector will selectively absorb onto one or more of the minerals present in such a way that these minerals in preference to the other minerals, become attached to the air bubbles. In this way the preferred minerals rise to the surface of the aqueous mass from whence they can be collected and a degree of mineral separation is thus brought about, In some cases the "gangue" or unwanted minerals are caused to float preferentially in this way, but more commonly the valuable minerals are floated and collected as a concentrate.

Complete selectivity with regard to separation of the minerals is difficult to achieve and frequently several sequential flotations are required before an adequate degree of ore refinement is obtained. Those flotations carried out on the crude ore are often referred to as "rougher" operations and reflotations of the "rougher" concentrates are often referred to as "cleaner" operations.

It is well known to add other chemical reagents to improve the selectivity of flotation processes, amongst which are substances which are termed "depressants" because of their general effect on the process which is to make the unwanted minerals less likely to be floated simultaneously with those which are required to be floated. The manner in which these modifying agents achieve their effect is not known with certainty and various theories have been offered as to their mode of action. It is possible that some of these materials act by preferential absorption onto the surface of the unwanted material and in consequence reduce the state of flocculation of these minerals or increase their hydrophilic properties, both of which would give them less tendency to adhere to the air bubbles, or they may prevent the associated minerals from adhering to the required minerals, or they may prevent the "collector" from absorbing onto the associated minerals or other mechanisms may be operative. Whatever the mechanism the utilisation of a "depressant" can have a valuable effect on the economics of the flotation process.

The variety of mineral substances which are subject to beneficiation by the froth flotation process is very wide and because very wide differences in the nature of the surfaces of these minerals and in the nature of the surfaces of the associated minerals exist because of chemical composition, prior processing etc., the number and type of chemical substances used as collectors is also very wide. Likewise the number and type of chemical substances used as depressants is very wide and in fact with regard to both types of materials a high degree of specificity of action exists.

Substances used in the past as gangue depressants in flotation processes cover a wide variety of chemical types and include, for instance, sodium silicate, starch, tannins, dextrins, lignosulphonic acids, carboxyl methyl cellulose, cyanide salts and many others. More recently certain synthetic polymers have been found advantageous in particular processes.

A very general disclosure of the use of synthetic polymers is in British patent specification No. 749,213. This describes how water soluble, anionic, linear addition polymers can be used as gangue depressants. It is stated that the invention is applicable "to gangue slimes of the most varied types of ores such as siliceous gangue present in metallic or sulphide ores, for example, lead, zinc, copper, pyrites, lead-zinc ores, precious metal ores. It is also applicable to the various gangues present in non-sulphide ores such as, for example, those of tungsten, manganese, barite, fluorspar, limestone and phosphate rock." It is clear that the depressant is intended to depress the gangue slime while the main ore, for example, pyrites, floats. The only depressants used in the actual working examples are polyacrylic acid and hydrolysed polyacrylonitriles, the latter being stated to be preferred.

However a very large number of other polymers are listed in the Specification, although not all of them are anionic. Included amongst this large number are dimethylaminoethyl polymethacrylate, methacrylic acid dimethylaminoethyl methacrylate copolymer and vinyl pyridine acrylonitrile copolymer. No examples of the use of these is given and there is no specific description of any particular ores on which they are alleged to be particularly useful. Examples 5 and 6 of the Specification describe the flotation of porphyry copper ore, which is a type of copper ore containing a very low (e.g. 2%) pyrites content.

In view of the high specificity of action of synthetic polymers as depressants it is perhaps rather unlikely that really useful results will be achieved with the many hundreds or thousands of theoretically possible conbinations of disclosed ores and disclosed polymer types. Indeed most literature on the use of synthetic polymers as depressants is very much more specific. Other literature on the use of acrylic polymers as depressants includes South African Pat. No. 67/2678, German Patent 1,267,631 and U.S. Pat. No. 3,452,867, and U.S. Pat. No. 3,017,028 has described the use of synthetic depressants in the flotation of potassium minerals. More recently French Pat. No. 2,175,174 has described the use of quaternary polymers of diallyl dialkyl ammonia as depressants for use in sulphide circuits.

Many non-ferrous metals are found in the form of metaliferous minerals in ores containing substantial quantities of pyrites and/or pyrrhotite and/or sphalerite. In particular these ores are often sulphide or oxidised sulphide ores. It has been our object to devise a froth flotation process in which a depressant is used which has the effect of resulting in improved concentration of the metaliferous minerals while the pyrites and/or pyrrhotite and/or sphalerite is depressed. It will be observed that in British patent specification No. 749,213 pyrites was one of the minerals that apparently was inteded to be floated, the gangue being depressed.

According to the invention we concentrate a metaliferous ore containing also a substantial quantity of pyrites and/or pyrrhotite and/or sphalerite by subjecting an aqueous pulp of the ore to a froth flotation process in the presence of a depressant and in which (1) pyrites and/or pyrrhotite, and/or (2) sphalerite, present in the ore are depressed by using, as the depressant, an amine compound in which at least 20% of the total number of amine groups are tertiary amine groups and in which the number of quanternary amine groups is from zero to not more than one-third the number of tertiary amine groups.

It seems that the tertiary amine compounds act as depressants for pyrites, pyrrhotite and sphalerite, and so their use can result in improved concentration by flotation of the desired metaliferous component from an ore containing any or all of pyrites, pyrrhotite and sphalerite. The ores to which the invention is most suitable applied are sulphide and oxidised sulphide ores containing substantial quantities of pyrites and/or pyrrhotite and/or sphalerite.

The desired metaliferous component of the ore may comprise minerals, generally the sulphide or oxide, of metals such as copper, nickel, lead and zinc. Most such minerals will float preferentially in a system in which pyrites and/or pyrrhotite is depressed but zinc minerals in particular have an inherent tendency not to float and so it is well known to include an activator to promote their flotation. Accordingly in the invention sphalerite can be depressed or not according to the manner in which the flotation is conducted, and in particular according to whether or not activator is present. The sphalerite may be activated by other components of the ore, for instance copper, but if not and if it is desired to be floated then suitable activators that may be added include copper and lead salts, for example copper sulphate and lead nitrate. Thus, the invention is applicable to processes in which pyrites and/or pyrrhotite are to be depressed while sphalerite is floated and to processes in which sphalerite is depressed, often in combination with pyrites and/or pyrrhotite, while other metaliferous component is floated. In the Examples below it will be observed that in some processes ores containing sphalerite have the concentration of sphalerite increased by the invention while in others ores containing sphalerite have the concentration of other components increased, the sphalerite being depressed.

Thus a preferred process according to the invention for concentrating an ore containing sphalerite and other metaliferous minerals, as well as pyrites and/or pyrrhotite, comprises subjecting the ore to flotation concentration in accordance with the invention in such a manner that the pyrites and sphalerite are both depressed and then subjecting it to another process that results in sphalerite being floated while pyrites and/or pyrrhotite is depressed, usually by conducting the process of the invention in the presence of an activator for the sphalerite.

The invention is primarily of use when the amount of pyrites and/or pyrrhotite and/or sphalerite that is to be depressed is more than 10%, and in particular when it is above 20%, e.g. 25 to 40%, by weight of the total weight of ore. Naturally if the sphalerite is to be floated then it must be excluded from these quantities which would then apply solely to the pyrites and pyrrhotite content of the ore. Generally the ore contains the specified quantities of pyrites alone, optionally with additional pyrrhotite and/or sphalerite.

In order for a depressant to be effective in a flotation process it must be water soluble or disperable. By water dispersable we merely mean that it must be possible to make a dispersion in the water of the flotation system that has temporary stability at least, so that a homogeneous mixture of the depressant and water can be formed that does not promptly settle out. It may be permanently stable or may gradually settle out upon storage over a period of at least several minutes. This requirement is conventional for depressants. The tertiary amine may be in free base form or may be in the form of a salt, for example the methyl sulphate, hydrochloride or acetate salt. This may improve its solubility.

The tertiary amine may also contain other amine groups although it is preferred that of the total number of amine groups at least one-third, and preferably half, are tertiary amine groups. The presence of quaternary amine groups tends to reduce the selectivity of the depressant and so it is preferred that there shall be none present, although satisfactory results are obtainable with small amounts, preferably less than one quarter. Preferably all the amine groups are tertiary amine groups.

The depressants in the invention may be polymeric or may be monomeric, that is to say simple organic compounds of low molecular weight.

Monomeric depressants preferably contain at least one tertiary amine group for every one hundred other atoms in the molecule and most preferably for every twenty five other atoms in the molecule. The compounds may be aromatic, suitable examples being all the vinyl pyridines and the analogues containing a C1–8 alkyl, e.g. a methyl, group in the ring, or may be aliphatic (including cycloaliphatic). In addition to the tertiary amine group, the depressants may also contain additional hydrophilic groups such as alcohol groups or carboxylic acid groups. Examples of such materials are triethanolamine, ethylene diamine tetraacetic acid and the reaction products of diethylene triamine with a suitable amount of an alkylating agent such as dimethyl sulphate. Other suitable groups of compounds are dialkylaminoalkyl acrylates and methacrylates, for example diethylaminoethyl acrylate. With non polymeric depressants the proportions of quaternary and tertiary amine groups may be as stated above but it is preferred that there should be no quaternary groups and that at least half, and preferably all, the amine groups shall be tertiary.

Polymeric depressants for use in the invention preferably contain at least one tertiary amine group for every 100 atoms, most preferably for every 25 atoms and often for every 15 or even fewer, for example eight or in some instances as low as two, atoms in the polymer chain. In referring to atoms in the polymer chain we mean the atoms that are linked together to form the chain structure of the linear or cross-linked polymer and we are not including atoms, such as hydrogen atoms, chemically bonded to chain atoms.

The polymers are preferably linear but some degree of chain branching and/or cross-linking is sometimes satisfactory provided the polymer, or its salt, still dissolves readily in water. The polymers may be synthetic or may be polymers that are found in nature, or their derivatives, which contain tertiary amine groups. A suitable example is diethylaminoethyl cellulose or other dialkylaminoalkyl cellulose, the alkyls preferably each containing 1 to 8, usually 1 to 4, carbon atoms. Synthetic polymers may be derived from aromatic monomers, for example aromatic tertiary amines. For instance polyvinyl pyridines, especially polyvinyl pyridine and analogues containing a C1–8, usually methyl, are suitable. However the polymers are often derived from aliphatic monomers, especially aliphatic amines.

One preferred type of polymer is that obtained by converting the amine groups in polyethylenimine into tertiary groups.

Suitable derivatives of polyethylenimine are those alkylated using between 0.20 and 1.25 moles of an alkylating agent such as dimethyl sulphate per nitrogen atom in the polymer. Suitable polyethylenimine polymers have a molecular weight distribution such that an aqueous solution containing 10% by weight of the polymer has a Brookfield viscosity of between 20 and 2,000 cp. (measured at 20 r.p.m.). Polyethylenimine is commercially available and the reaction between polyethylenimine and dimethyl sulphate may take place in the presence of water. As the dimethyl sulphate reacts it dissolves in the water and heat is produced.

Another preferred type of polymer is the condensation product of a dibasic carboxylic acid with a polyalkylene polyamine, in which some at least of the secondary amine groups present initially are reacted to form tertiary amine groups. Thus the reaction product may be treated with an alkylating agent such as dimethylsulphate or a cross-linking agent such as epichlorhydrin. A suitable reaction product is that of adipic acid with diethylene triamine. Such products may be prepared by any suitable chemical reaction such as by reacting equimolar proportions of the dicarboxylic acid and the polyalkylene polyamine at a temperature of about 150° for about 6 hours with continuous removal of liberated water by distillation. The molecular weight of the resulting resin will depend upon the reaction conditions, in particular on the temperature and the time for which the reaction is carried out, and also upon the choice of starting materials. Suitable resins have a molecular weight indicated by a viscosity measured in centistokes as an aqueous solution at 25% w/w solids, using a suspended level viscometer of between 5 (No. 2 viscometer) and 60 (No. 2A Viscometer).

The resin may be dissolved in water and an amount of epichlorhydrin added to produce cross-linking. The degree of cross-linking may be varied by varying the amount of epichlorhydrin added, and the degree to which the crosslinking reaction proceeds. Adjusting the solution pH to about 3.5 with, for example, concentrated sulphuric acid, causes the cross-linking agent to become inactive. The amount of epichlorhydrin used may be as large as 0.75 mole for each mole of amine available in the resin, but an amount between 0.1 and 0.6 moles is preferred, and the reaction is allowed to proceed until a suitable viscosity is obtained, at which point sulphuric acid may be added to stop the cross-linking reaction. Suitable cross-linked products have a viscosity measured in centipoises at 10% solids at a pH of 3.5 using a Brookfield model RVT viscometer at a spindle speed of 100 rpm, using the spindle No. 1 of between 7 and 500.

Alternatively the adipic acid diethylene triamine resin may be treated with an alkylating agent, and the preferred derivatives are prepared using between 0.20 and 1.25 moles of an alkylating agent such as dimethyl sulphate per mole of amine in the polymer.

Other suitable polymers include those in which the nitrogen atom is not itself a link in the polymer chain, but is chemically joined to it as for example in acrylic polymers and copolymers prepared using monomers such as dialkylamino alkyl (usually ethyl) acrylates or methacrylates such as diethyl amino ethyl acrylate or dimethyl amino ethyl methacrylate. Such polymers can however have the disadvantage that the ester linkage may be hydrolysed in the alkaline pulps often encountered in the flotation of metal ores. The polymers may be homopolymers or copolymers with up to 50 mole percent of other vinyl comonomer, e.g. acrylamide. Preferred acrylic polymers are polymers containing dialkylaminoalkyl acrylamide groups. Such polymers are preferably obtained by reacting an acrylic polymer containing a substantial proportion of acrylamide groups (generally at least 50% and preferably 100% acrylamide groups) with formaldehyde and a secondary amine (such as dimethylamine) by the Mannich reaction. Typical products have the formula

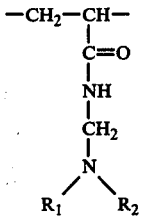

where $R_1$ and $R_2$ are alkyl groups containing from 1 carbon to 4 carbon atoms.

The presence of other acrylic or vinyl monomers in the polymers is not deleterious provided they neither render the polymer insoluble in water nor contain a substantial number of quaternary amine groups.

The molecular weight of the polymeric depressants used in this invention is not of primary importance. Good results have been obtained using polymers having molecular weights in the range 5,000 to 50,000 but polymers of higher molecular weight are also effective provided they may readily be dissolved in water or may easily be dispersed in the flotation pulp.

Throughout this specification alkyl and alkylene groups contain 1 to 8, preferably 1 to 4 carbon atoms unless otherwise specified.

The use of the depressants in the invention gives gocd results at very economical dosage levels, in general in the range of 5 to 250 gm per tonne, i.e. 5 to 250 gm of depressant per tonne of solid ore in the flotation feed. Hereinafter these dosages will be referred to in the abbreviated form of 5 to 250 gm per tonne. For instance good results have been obtained using a dose of depressant corresponding to about 170 gms per tonne, but in other instances doses of 70 gms/tonne or less have proved sufficient. The use of an excessive amount of depressant will usually lead to a fall in the recovery of the mineral which is being floated.

The froth flotation of the present invention should be carried out in accordance with good flotation practice and critical or unusual techniques are not necessary. In general any mechanical flotation machine may be employed or air cells may be used. For the purpose of this invention the collectors usually employed for collecting the ore may be used, for example, the commercially available xanthate collectors, and in particular dialkyl thionocarbamates have tended to give good results when used in conjunction with the depressants of the present invention for the flotation of copper and zinc minerals.

The pH may vary widely, but in common with other flotation systems separating metaliferous minerals from pyrite and/or pyrrhotite and/or sphalerite high pH values, e.g. 8 to 12 give best results. Conventional frothers, e.g. Methyl Isobutyl Carbinol, pine oil or polypropylene oxides may be used in accordance with normal flotation practice.

As in conventional flotation practice, the natural ore being beneficiated is usually first ground to the "liberation mesh" size and slurried with water. The depressant is added in water solution to the slurried ore whilst the ore is agitated. The collector may then be added in water solution to the agitated slurry and after a short time the slurry may be treated by conventional methods of froth flotation. The depressant should be added to the slurry in a manner such that the depressant may readily be dispersed throughout the slurry.

The froth flotation of the present invention commonly though not always involves flotation in "rougher cells" followed by one or more "cleanings" of the rougher concentrates. In some instances, however, it is common practice to carry out a "bulk sulphide" flotation designed to separate all the sulphide minerals together, and this is then followed by a selective flotation to remove metal values from the remaining pyritic gangue. The present invention can be used to advantage in both instances, either during the flotation of sulphide minerals from the ore, or during the selective removal of metal values from a previously floated "bulk sulphide" concentrate.

It is possible to carry out rougher and cleaner flotations with single additions of collecting and depressing reagents at the beginning of the operation. On the other hand it is often advantageous to use additions of collecting and depressing reagents at each flotation stage. The exact reagent additions at each stage will depend on the grade of the ore and the associated minerals. Pulp densities are in general the same as in other applications of froth flotation, for example between about 15 to 45% of solids by weight.

While it is practical, and in most operations preferable, to float with the depressants as the only depressants it is also possible to use them on conjunction with other depressants, such as the known depressants including, e.g. soluble silicates, lignosulphonates and cyanide salts.

The following Examples illustrate the invention:

EXAMPLE 1

The flotation feed was a copper ore containing chalcopyrite, pyrite, covellite, chalcocite and andesine with minor amounts of sphalerite, silica, montmorillonite clay, carbonates and metal oxides. After grinding, the ore assaying about 1.5% copper was treated by a laboratory Wemco Fagergren flotation cell as follows: A rougher concentrate was removed in three stages at a pH of 11.5 using commercially available Isopropyl ethyl thionocarbamate at doses of 10 gm. per tonne, 10 gm per tonne and 20 gm per tonne respectively in the presence of about 170 gm per tonne of depressant polymer.

The depressant used was a derivative of the condensation product of equimolar amounts of adipic acid and diethylen triamine. The condensation product had a viscosity at 25% solids of about 30 cs. The derivative was prepared by treating the condensation product with 0.2 moles of epichlorhydrin per mole of diethylene triamine used, until the cross linking reaction had produced a reagent having an aqueous viscosity at 40% w/w solids measured at 25° C. using a Brookfield model RVT viscometer and using spindle No. 3 rotating at 100 rpm of about 500 centipoise, at which point the pH was adjusted to 3.5 using concentrated hydrochloric acid. The viscosity of the resulting polymer in aqueous solution at 10% solids measured using a Brookfield viscometer was 15 cp (using spindle No. 1 at 20 rpm).

The depressant was added to the agitated pulp and a 3 minute conditioning period was allowed before addition of the first dose of collector. After a further three minutes conditioning and the addition of about 40 gm per tonne of Methyl Isobutyl Carbinol as frother, flotation was commenced. At the second and third stages of flotation no further depressant was added, but the addition of the collector dose was followed by 3 minutes conditioning before flotation was recommended, in accordance with normal laboratory flotation techniques. A further dose of 40 gm per tonne of Methyl Isobutyl Carbinol frother was added at the third stage of flotation.

The results were as follows:

| | | % Weight of Floated Concentrate | % Copper Assay | % Copper Distribution |
|---|---|---|---|---|
| 1st | Rougher concentrate | 9.3 | 8.0 | 55.3 |
| 2nd | Rougher Concentrate | 6.3 | 3.4 | 16.0 |
| 3rd | Rougher Concentrate | 6.3 | 2.1 | 9.9 |
| Tails | | 78.1 | .32 | 18.7 |
| | | 100.0 | 1.34 | 99.9 |

*This figure represents the % recovery of copper at each stage.

As a control experiment the same procedure was carried out on an identical sample of ore, omitting only the depressant addition, with the following results:

| | | % Weight of Floated Concentrate | % Copper Assay | % Copper Distribution |
|---|---|---|---|---|
| 1st | Rougher Concentrate | 15.6 | 5.6 | 59.6 |
| 2nd | Rougher Concentrate | 7.3 | 1.9 | 9.5 |
| 3rd | Rougher Concentrate | 4.6 | 1.7 | 5.2 |
| Tails | | 72.5 | .52 | 25.7 |
| | | 100.0 | 1.47 | 100.0 |

Clearly a substantial increase in the copper assays is obtained in the presence of the depressant of the invention.

EXAMPLE 2

The flotation feed and procedure were the same as in Example 1, but the collector used was potassium amyl xanthate at doses of 20 gms/tonne, 20 gms/tonne and 40 gms/tonne respectively and the depressant polymer of Example 1 was used at a dose of 170 gms/tonne with the following results.

| | | % Weight of Floated Concentrates | % Copper Assay | % Copper Distribution |
|---|---|---|---|---|
| 1st | Rougher | 13.5 | 6.7 | 54.5 |

-continued

| | | % Weight of Floated Concentrates | % Copper Assay | % Copper Distribution |
|---|---|---|---|---|
| | concentrate | | | |
| 2nd | Rougher concentrate | 5.3 | 3.0 | 9.5 |
| 3rd | Rougher concentrate | 10.3 | .77 | 4.8 |
| Tails | | 70.9 | .73 | 31.1 |
| | | 100.0 | 1.66 | 99.9 |

As a control, the same procedure was carried out on an identical sample of ore omitting only the depressant additions, with the following results:

| | | % Weight of Floated Concentrates | % Copper Assay | % Copper Distribution |
|---|---|---|---|---|
| 1st | Rougher Concentrate | 12.9 | 5.8 | 48.1 |
| 2nd | Rougher Concentrate | 7.9 | 2.3 | 11.7 |
| 3rd | Rougher Concentrate | 7.9 | .95 | 4.8 |
| Tails | | 71.2 | .77 | 35.4 |
| | | 99.9 | 1.55 | 100.0 |

EXAMPLE 3 (Comparison)

A flotation feed similar to that of example 1, but slightly oxidised was treated using a laboratory Denver flotation cell. A rougher concentrate was removed in three stages at a pH of 11.5 using commercially available isopropyl ethyl thiono carbamate at doses of 25 gms/tonne, 25 gms/tonne and 50 gms/tonne respectively. A depressant being polyethylenimine having a viscosity of 45 cps measured using a Brookfield viscometer (No. 1 spindle at 20 rpm) in aqueous solution at 10% solids at a pH of 7 was added at a dose of 70 gms/tonne to the pulp and a 3 minute conditioning period allowed before the addition of the first dose of collector. After each addition of collector a 3 minute conditioning period was allowed. 80 gms/tonne methyl isobutyl carbinol frother was added at the first and third stages of flotation.

The results were as follows:

| | | % Weight of Floated Concentrate | % Copper Assay | % Copper Distribution |
|---|---|---|---|---|
| 1st | Rougher Concentrate | 28.1 | 3.1 | 57.1 |
| 2nd | Rougher Concentrate | 9.0 | 1.6 | 9.5 |
| 3rd | Rougher Concentrate | 8.2 | 1.8 | 9.4 |
| Tails | | 54.7 | 0.67 | 24.0 |
| | | 100.0 | 1.53 | 100.0 |

As a control experiment the same procedure was carried out on an identical sample of ore, omitting only the depressant addition, with the following results:

| | | % Weight of Floated Concentrate | % Copper Assay | % Copper Distribution |
|---|---|---|---|---|
| 1st | Rougher Concentrate | 32.1 | 2.9 | 59.6 |
| 2nd | Rougher Concentrate | 8.7 | 1.7 | 9.9 |
| 3rd | Rougher Concentrate | 8.2 | 1.8 | 9.3 |

-continued

| | % Weight of Floated Concentrate | % Copper Assay | % Copper Distribution |
|---|---|---|---|
| Tails | 51.0 | 0.66 | 21.7 |
| | 100.0 | 1.55 | 100.0 |

EXAMPLE 4

The flotation feed and procedure of Example 3 were used but the depressant used here was the reaction product of the depressant of Example 3 with 0.5 mols of dimethyl sulphate per mole of amine at a dose of 70 gms/tonne with the following results:

| | | % Weight of Floated Concentrate | % Copper Assay | % Copper Distribution |
|---|---|---|---|---|
| 1st | Rougher Concentrate | 18.1 | 4.3 | 50.8 |
| 2nd | Rougher Concentrate | 5.4 | 1.6 | 5.7 |
| 3rd | Rougher Concentrate | 8.2 | 1.5 | 7.8 |
| Tails | | 68.3 | 0.80 | 35.7 |
| | | 100.0 | 1.53 | 100.0 |

EXAMPLE 5

The flotation feed and procedure of Example 3 were used, and the reaction product of the depressant of Example 3 with 1.0 mole of dimethyl sulphate per mole of amine was used as depressant at a dose of 70 gms/tonne with the following results.

| | % Weight of Floated Concentrate | % Copper Assay | % Copper Distribution |
|---|---|---|---|
| 1st Rougher Concentrate | 20.1 | 4.5 | 57.7 |
| 2nd Rougher Concentrate | 9.8 | 1.6 | 9.8 |
| 3rd Rougher Concentrate | 7.4 | 1.5 | 6.9 |
| Tails | 62.7 | 0.64 | 25.6 |
| | 100.0 | 1.57 | 100.0 |

EXAMPLE 6 (Comparison)

The flotation feed and procedure of Example 3 were used, and the reaction product of the depressant of example 3 with 1.5 mols of dimethyl sulphate per mole of amine was used as a depressant at a dose of 70 gms/tonne with the following results:

| | % Weight of Floated Concentrate | % Copper Assay | % Copper Distribution |
|---|---|---|---|
| 1st Rougher Concentrate | 23.5 | 3.2 | 48.9 |
| 2nd Rougher Concentrate | 8.5 | 1.6 | 8.6 |
| 3rd Rougher Concentrate | 8.1 | 1.6 | 8.5 |
| Tails | 59.9 | 0.87 | 34.0 |
| | 100.0 | 1.53 | 100.0 |

Comparison of the results of Examples 3, 4, 5 and 6 shows clearly the influence of Tertiary Amine groups, particularly in the grade of copper floated in the 1st Rougher Concentrates. The depressant polymer of Example 3 which contains very few tertiary amine groups has shown little improvement over the control test. The depressant polymer of Example 4 which contains approximately equal numbers of secondary and tertiary amine groups has given improved concentrate grades. The depressant polymer of Example 5 containing a large number of tertiary amine groups and relatively few quaternary amine groups has given the best results of the series. The depressant polymer of Example 6 containing equal numbers of tertiary and quaternary amine groups has clearly given significantly less good results, results which are in fact hardly better than those of the control test.

EXAMPLE 7

The flotation feed and procedure of example 3 were used and the depressant used was the reaction product of a depressant similar to that of Example 1 but having a viscosity at 25% w/w solids at 25° C. using a No. 2 suspended level viscometer of 10.8 cs and 1.0 mole of dimethyl sulphate per mole of amine in the polymer at a dose of 70 gms/tonne with the following results:

| | % Weight of Floated Concentrate | % Copper Assay | % Copper Distribution |
|---|---|---|---|
| 1st Rougher Concentrate | 15.4 | 4.8 | 46.9 |
| 2nd Rougher Concentrate | 8.3 | 2.0 | 11.4 |
| 3rd Rougher Concentrate | 7.5 | 1.9 | 9.0 |
| Tails | 68.8 | 0.77 | 33.7 |
| | 100.0 | 1.57 | 100.0 |

EXAMPLE 8

The flotation feed and procedure of Example 3 were used, and the depressant used was the reaction product of polyacrylamide with 1 mole of formaldehyde and 1 mole of dimethylamine. The polymer had a viscosity in aqueous solution at 10% solids of 4,400 cp. (Brookfield, 20 rpm, spindle No. 5). The polymer was used at a dose of 35 gms/tonne with the following results:

| | % Weight of Floated Concentrate | % Copper % Copper Assay | % Copper Distribution |
|---|---|---|---|
| 1st Rougher Concentrate | 15.9 | 4.2 | 45.1 |
| 2nd Rougher Concentrate | 8.4 | 1.8 | 10.1 |
| 3rd Rougher Concentrate | 7.9 | 1.8 | 9.6 |
| Tails | 67.8 | 0.77 | 35.2 |
| | 100.0 | 1.49 | 100.0 |

EXAMPLE 9

The flotation feed and procedure for Example 3 were used, and the depressant used was a homopolymer of diethylamino ethylacrylate having a viscosity at 10% solids of 138 cp (Brookfield 20 rpm, spindle No. 1). The polymer was used at a dose of 70 gms/tonne with the following results:

| | % Weight of Floated Concentrate | % Copper Assay | % Copper Distribution |
|---|---|---|---|
| 1st Rougher Concentrate | 19.1 | 3.8 | 47.9 |
| 2nd Rougher Concentrate | 7.0 | 1.7 | 7.8 |
| 3rd Rougher Concentrate | 5.7 | 1.8 | 6.5 |
| Tails | 68.2 | 0.85 | 37.8 |
| | 100.0 | 1.53 | 100.0 |

EXAMPLE 10 (Comparison)

The flotation feed and procedure of Example 3 were used and the depressant used was a homopolymer of dimethyl sulphate quaternised diethylaminoethylacrylate. The polymer was used at a dose of 70 gms/tonne with the following results:

| | % Weight Floated Concentrate | % Copper Assay | % Copper Distribution |
|---|---|---|---|
| 1st Rougher Concentrate | 28.7 | 2.4 | 47.3 |
| 2nd Rougher Concentrate | 5.5 | 2.1 | 7.8 |
| 3rd Rougher Concentrate | 7.2 | 1.8 | 9.0 |
| Tails | 58.6 | 0.89 | 35.9 |
| | 100.0 | 1.46 | 100.0 |

This example again illustrates the deleterious effects of quaternary polymers.

EXAMPLE 11

The flotation feed and procedure of Example 3 were used and the depressant used was a copolymer containing equal weights of acrylamide and diethylamino ethyl acrylate having a viscosity in aqueous solution at 10% solids of 108 cp (Brookfield at 20 rpm using spindle No. 1) at a dose of 50 gms/tonne with the following results:

| | % Weight of Floated Concentrate | % Copper Assay | % Copper Distribution |
|---|---|---|---|
| 1st Rougher Concentrate | 24.3 | 3.4 | 52.3 |
| 2nd Rougher Concentrate | 8.2 | 1.9 | 10.2 |
| 3rd Rougher Concentrate | 8.2 | 1.7 | 9.1 |
| Tails | 59.3 | 0.75 | 28.4 |
| | 100.0 | 1.56 | 100.0 |

EXAMPLE 12

The flotation feed and procedure of Example 3 were used and the depressant used was ethylenediamine tetra acetic acid at a dose of 60 gms/tonne. The following results were obtained:

| | % Weight Floated Concentrate | % Copper Assay | % Copper Distribution |
|---|---|---|---|
| 1st Rougher Concentrate | 28.9 | 3.3 | 59.5 |
| 2nd Rougher Concentrate | 10.6 | 1.5 | 10.0 |
| 3rd Rougher Concentrate | 8.9 | 1.5 | 8.0 |
| Tails | 51.6 | 0.70 | 22.5 |

-continued

| | % Weight Floated Concentrate | % Copper Assay | % Copper Distribution |
|---|---|---|---|
| | 100.0 | 1.60 | 100.0 |

Although the first rougher concentrate has a relatively low grade, when the high recovery is taken into account, it is clear that a more selective separation has occured.

EXAMPLE 13

The flotation feed and procedure of Example 3 were used, and triethanolamine was used as depressant at a dose of 70 gms/tonne with the following results:

| | % Weight of Floated Concentrate | % Copper Assay | % Copper Distribution |
|---|---|---|---|
| 1st Rougher Concentrate | 20.6 | 3.9 | 52.9 |
| 2nd Rougher Concentrate | 11.2 | 1.7 | 12.3 |
| 3rd Rougher Concentrate | 5.1 | 1.6 | 5.5 |
| Tails | 63.1 | 0.70 | 29.3 |
| | 100.0 | 1.51 | 100.0 |

EXAMPLE 14 (Comparison)

The flotation feed and procedure of Example 3 were used and for comparison with Example 13 monoethanolamine was used as depressant at a dose of 70 gms/tonne with the following results:

| | % Weight of Floated Concentrate | % Copper Assay | % Copper Distribution |
|---|---|---|---|
| 1st Rougher Concentrate | 26.1 | 3.2 | 52.9 |
| 2nd Rougher Concentrate | 7.1 | 1.9 | 8.7 |
| 3rd Rougher Concentrate | 6.3 | 1.9 | 7.7 |
| Tails | 60.5 | 0.80 | 30.7 |
| | 100.0 | 1.58 | 100.0 |

This comparison shows that whilst primary amine does give an improvement in the Copper Assay particularly in the 1st rougher concentrate, it is not nearly as effective as a tertiary amine.

EXAMPLE 15

The flotation feed and procedure of Example 3 were used and the depressant used was the product of the reaction of 1 mole of diethylene triamine and 2.5 moles of dimethyl sulphate. The depressant was used at a dose of 70 gms/tonne with the following results:

| | % Weight of Floated Concentrate | % Copper Assay | % Copper Distribution |
|---|---|---|---|
| 1st Rougher Concentrate | 17.4 | 4.1 | 49.2 |
| 2nd Rougher Concentrate | 10.2 | 1.7 | 11.7 |
| 3rd Rougher Concentrate | 7.7 | 1.8 | 9.2 |
| Tails | 64.7 | 0.68 | 29.9 |
| | 100.0 | 1.47 | 100.0 |

EXAMPLE 16

The flotation feed and procedure of Example 3 were used and the depressant used was diethylaminoethyl acrylate monomer. The depressant was used at a dose of 70 gms/tonne with the following results:

| | % Weight of Floated Concentrate | % Copper Assay | % Copper Distribution |
|---|---|---|---|
| 1st Rougher Concentrate | 21.7 | 3.6 | 52.9 |
| 2nd Rougher Concentrate | 8.3 | 1.7 | 9.8 |
| 3rd Rougher Concentrate | 6.7 | 1.7 | 7.6 |
| Tails | 63.3 | 0.69 | 29.7 |
| | 100.0 | 1.47 | 100.0 |

The improved results found here using diethylaminoethyl acrylate monomer are very similar to the results of Example 9 where a homopolymer of diethylaminoethyl acrylate was used as depressant. This clearly shows that it is the presence of the tertiary amine groups which is of prime importance in determining the effectiveness of the reagent, with molecular weight only of minor importance.

EXAMPLE 17

The flotation feed was a zinc ore containing sphalerite together with pyrite and siliceous gangue minerals including silica and tourmaline and small amounts of chalocopyrite arsenopyrite and cassiterite. After grinding, the ore, assaying about 3.5% zinc, was treated using a Denver laboratory flotation cell. A rougher concentrate was removed in three stages at a pH of 11.5 using commercially available isopropyl ethyl thionocarbonate at doses of 22.5 gms/tonne. Two minutes before the addition of collector at each stage 90 gms/tonne $CuSO_45H_2O$ was added as activator for the sphalerite. The depressant of Example 1 was added at a dose of 18 g/tonnes 2 minutes after the first collector addition and flotation was commenced a further 2 minutes later. The results were as follows:

| | % Weight of Floated Concentrate | % Zinc Assay | % Zinc Distribution |
|---|---|---|---|
| 1st Rougher Concentrate | 10.3 | 27.8 | 78.8 |
| 2nd Rougher Concentrate | 6.1 | 6.3 | 10.6 |
| 3rd Rougher Concentrate | 5.6 | 2.6 | 4.1 |
| Tails | 78.0 | 0.3 | 6.5 |
| | 100.0 | 3.6 | 100.0 |

As a control experiment the same procedure was carried out on an identical sample of ore, omitting only the depressant addition with the following results:

| | % Weight of Floated Concentrate | % Zinc Assay | % Zinc Distribution |
|---|---|---|---|
| 1st Rougher Concentrate | 15.3 | 19.9 | 86.8 |
| 2nd Rougher Concentrate | 4.6 | 3.3 | 4.3 |
| 3rd Rougher Concentrate | 4.5 | 1.9 | 2.4 |
| Tails | 75.6 | 0.3 | 6.5 |

-continued

| | % Weight of Floated Concentrate | % Zinc Assay | % Zinc Distribution |
|---|---|---|---|
| | 100.0 | 3.5 | 100.0 |

EXAMPLE 18

The flotation feed and procedure of Example 17 were used and the depressant of Example 5 was used at a dose of 15 gms/tonne with the following results:

| | % Weight of Floated Concentrate | % Zinc Assay | % Zinc Distribution |
|---|---|---|---|
| 1st Rougher Concentrate | 11.2 | 27.7 | 84.8 |
| 2nd Rougher Concentrate | 7.0 | 3.3 | 6.3 |
| 3rd Rougher Concentrate | 4.6 | 2.1 | 2.6 |
| Tails | 77.2 | 0.3 | 6.3 |
| | 100.0 | 3.7 | 100.0 |

EXAMPLE 19

The flotation feed and procedure of Example 17 were used. The depressant used was prepared by reacting equimolar amounts of adipic acid and bis-3-amino propyl methylamine to form a condensation polymer similar to that of Example 1, but already containing a large number of tertiary amine groups. The depressant was used at a dose of 45 gms/tonne with the following results:

| | % Weight of Floated Concentrate | % Zinc Assay | % Zinc Distribution |
|---|---|---|---|
| 1st Rougher Concentrate | 10.4 | 25.9 | 80.0 |
| 2nd Rougher Concentrate | 5.6 | 5.9 | 9.7 |
| 3rd Rougher Concentrate | 4.3 | 2.5 | 3.2 |
| Tails | 79.7 | 0.3 | 7.1 |
| | 100.0 | 3.4 | 100.0 |

EXAMPLE 20

The flotation feed was a lead ore containing galena, sphalerite, pyrite and siliceous gangue minerals. After grinding, the ore, assaying about 2% lead, was treated using a Denver laboratory flotation cell. A rougher concentrate was removed at a pH of 9.5 using sodium isopropyl xanthate at a dose of 80 gms/tonne. MIBC frother was used at a dose of 60 gms/tonne. The depressant of Example 5 was used at a dose of 35 gms/tonne. The depressant was added 3 minutes after the collector and a further 3 minutes conditioning was allowed after the depressant addition before flotation was commenced. A concentrate assaying 6.74% lead with a recovery of 77.9% was obtained from a feed assaying 1.86% lead.

As a control experiment the same procedure was carried out on an identical sample of ore, omitting only the depressant addition and subsequent conditioning period. A concentrate assaying 5.99% lead with a recovery of 79.4% was obtained from a feed assaying 1.93% lead.

| | Assay % | | | Distribution % | | |
|---|---|---|---|---|---|---|
| | Pb | Zn | Fe | Pb | Zn | Fe |
| Feed | 1.9 | 6.6 | 23.9 | 100 | 100 | 100 |
| Concentrate | 6.7 | 7.2 | 26.0 | 77.9 | 23.4 | 23.4 |
| Tails | 0.53 | 6.5 | 23.3 | 22.1 | 76.6 | 76.6 |
| Control | | | | | | |
| | 1.9 | 6.5 | 22.4 | 100 | 100 | 100 |
| | 6.0 | 7.6 | 26.7 | 79.4 | 29.7 | 30.5 |
| | 0.54 | 6.2 | 20.9 | 20.6 | 70.3 | 69.5 |

It can also be seen that substantial reduction in Zn and Fe contents of the concentrate has taken place.

EXAMPLE 21

The flotation feed and procedure of example 20 were used. The depressant used was a homopolymer of vinyl pyridine which was used at a dose of 30 gms./tonne. A concentrate assaying 6.61% lead with a recovery of 79.9% was obtained from a feed assaying 1.80% lead.

EXAMPLE 22

The flotation feed was a nickel sulphide ore containing a substantial amount of pyrrhotite. After grinding, the ore, assaying about 2.5% nickel, was treated using a Denver laboratory flotation cell. A rougher flotation concentrate was removed in two stages at a pH of 10 using a commercially available dithiouocarbonate collector at doses of 50 gms/tonne and 100 gms/tonne and 100 gms/tonne. MIBC frother was used at a dose of 20 gms/tonne at each stage. The depressant of example 1 was used at a dose of 20 gms/tonne at the first stage and was added 3 minutes after the addition of collector. A four minute conditioning period was then allowed before flotation was commenced, the frother being added after 3 minutes. No depressant was added at the second stage of flotation, and the collector was allowed a 4 minute conditioning period before flotation was commenced, the frother being added after 3 minutes. Flotation was carried out for 5 minutes at the first stage and for 4 minutes at the second. The following results were obtained:

| | % weight | Assays | | Distribution % | |
|---|---|---|---|---|---|
| | Floated | % N: | %Fe | N: | Fe |
| 1st Rougher concentrate | 13.7 | 11.1 | 24.2 | 62.7 | 19.0 |
| 2nd Rougher concentrate | 4.2 | 5.4 | 22.5 | 9.4 | 5.5 |
| Tails | 82.1 | 0.83 | 16.1 | 27.9 | 75.5 |
| | 100 | 2.4 | 17.5 | 100 | 100 |

As a control experiment another sample of the same ore was treated using the same procedure, and omitting only the depressant addition. The following results were obtained.

| | % Weight | Assays | | Distribution % | |
|---|---|---|---|---|---|
| | floated | % N: | % Fe | N: | Fe |
| 1st, Rougher concentrate | 16.7 | 9.2 | 27.4 | 64.0 | 25.3 |
| 2nd, Rougher concentrate | 4.2 | 4.6 | 25.8 | 7.9 | 5.9 |
| Tails | 79.1 | 0.86 | 15.8 | 28.1 | 68.8 |
| | 100 | 2.4 | 18.1 | 100 | 100 |

We claim:

1. A method of concentrating a metaliferous sulphide or oxidized sulphide ore containing desired metal oxide or sulphide selected from copper, nickel, and lead oxides and sulphides, and containing also substantial quantities of one or more impurities selected from the group consisting of pyrites, pyrrhotite and sphalerite; which comprises subjecting an aqueous pulp of the ore to a froth flotation process in the presence of a collector and a depressant for said impurities, the depressant being an amine polymer containing amine groups, said polymer being homopolymers or copolymers in which at least 50% of the monomers from which they are made contain amine groups, and wherein at least 20% of the total number of amine groups in the depressant are tertiary amine groups and the number of quaternary amine groups present is zero or is less than one-third the number of tertiary amine groups, whereby the impurities are depressed while the desired metal oxide or sulphide is collected and separated therefrom.

2. A method according to claim 1 wherein the polymer contains amine groups in which the nitrogen atom is a link in the polymer chain structure.

3. A method according to claim 1 in which the number of quaternary groups in the amine depressant is less than one quarter the number of tertiary amine groups.

4. A method according to claim 1 in which at least half the amine groups in the amine depressant are tertiary amine groups.

5. A method according to claim 1 in which the polymeric amine is diethylaminoethyl cellulose, polyvinyl pyridine, alkylated polyethenimine, a condensation product containing tertiary amine groups of adipic acid with diethylene triamine and polymers containing recurring diethylaminoethyl acrylate or dimethylaminoethyl methacrylate units or polymers containing dialkylaminomethyl acrylamide groups.

6. A method according to claim 1 conducted in the presence of a xanthate collector.

7. A method of treating a zinc ore containing sphalerite and substantial quantities of one or more impurities selected from the group consisting of pyrites and pyrrhotites; which comprises subjecting an aqueous pulp of the ore to froth flotation in the presence of a collector and a depressant for said impurities, the depressant being an amine polymer containing amine groups, said polymer being homopolymers or copolymers in which at least 50% of the monomers from which they are made contain amine groups, and wherein at least 20% of the total number of amine groups in the depressant are tertiary amine groups and the number of quaternary amine groups present is zero or is less than one-third the number of tertiary amine groups, and also in the presence of an activator for the sphalerite, whereby the impurities are depressed while the sphalerite is collected and separated therefrom.

8. The method of claim 7 wherein the polymer contains amine groups in which the nitrogen atom is a link in the polymer chain structure.

* * * * *